United States Patent [19]

Georgiev et al.

[11] Patent Number: 5,038,128

[45] Date of Patent: Aug. 6, 1991

[54] MAGNETIC GRIPPER

[75] Inventors: Valentin G. Georgiev; Plamen D. Stoev; Zantcho B. Zanev; Stojan D. Stojanov; Assen G. Georgiev, all of Sofia, Bulgaria

[73] Assignee: P S P "Metalsnab" , Lom, Bulgaria

[21] Appl. No.: 378,297

[22] Filed: Jul. 11, 1989

[51] Int. Cl.[5] ..... H01F 7/20

[52] U.S. Cl. ..... 335/290; 335/291

[58] Field of Search ..... 335/289, 290, 291, 292, 335/294, 295

[56] References Cited

U.S. PATENT DOCUMENTS 4,090,162 5/1978 Cardone et al. ..... 335/289
4,594,568 6/1986 Hubner et al. ..... 335/289

FOREIGN PATENT DOCUMENTS 0206107 12/1983 Japan ..... 335/289
1082744 3/1984 U.S.S.R. .
1272488 4/1972 United Kingdom ..... 335/291

*Primary Examiner*—George Harris

*Attorney, Agent, or Firm*—Herbert Dubno

[57] ABSTRACT

A magnetic gripper avoiding the disadvantages of the well-known devices of reduced lifting capacity, increased electric power consumption and small gripping force finds application in mechanical engineering for the transportation of ferromagnetic materials. The device has a U-shaped casing of magnetic soft material, at least two pairs of permanent magnets, one of their ends resting on the casing and the other on a common pole terminal enveloped in a neutralizing winding and all magnets are enveloped by a magnetizing winding. The magnetic gripper can lift thick sheets and packs of thin sheets when short-time current pulse of the magnetizing winding is fed and the permanent magnets are magnetized in one direction, the magnetic flux formed is collected in the common pole terminal. To free the sheets, a current pulse of the common neutralizing winding is fed and the direction of magnetization is reversed. For the regulation of the gripping force in some sectors of the poles, the magnetic flux is summed and in others is subtracted, thus achieving changes of the gripping force on a wide range with reduced energy consumption.

4 Claims, 2 Drawing Sheets

MAGNETIC GRIPPER

FIELD OF THE INVENTION

This invention relates to a magnetic gripper finding application in mechanical engineering for gripping and conveying ferromagnetic materials.

BACKGROUND OF THE INVENTION

There is a well-known magnetic gripper (Soviet patent document 1,082,749) consisting of a U-shaped casing of magnetically sort material in which at least two pairs of permanent magnets with control windings on them are housed. One of the magnets of each pair of magnets is neutralizing. One of the poles of the permanent magnets rests on the upper part of the U-shaped casing, and the other pole in a common pole terminal.

The disadvantages of this well known magnetic gripper are the reduced lifting capacity due to large magnetic losses in the magnetic circuit, the high electric power consumption, the penetration of the magnetic field deep into the sheet material, the small gripping force for thin sheets, and the complicated and energy consuming material demagnetization and the regulation of the force of gripping.

OBJECT OF THE INVENTION

The object of this invention is to make a magnetic gripper of improved lifting capacity, reduced electric power consumption, simplified construction, reduced penetration of the magnetic field into the material, improved gripping force for thin sheets, and improved capabilities for demagnetization and regulation of the gripping force accompanied by reduced energy consumption and simplified control.

SUMMARY OF THE INVENTION

This object is achieved by a magnetic gripper consisting of a casing of magnetically soft material and U-shape form (section) wherein at least two pairs of permanent magnets are housed, one of the ends of each permanent magnet resting on the upper part of the casing, and its other end in a common pole terminal. One magnet each of every pair of permanent magnets is enveloped by a neutralizing winding, and all magnets and the common pole terminal are enveloped by a magnetizing winding. In another embodiment, at least one supplementary pole along the interpolar distance is placed between the poles of the U-shaped section casing and the common pole terminal under the common magnetizing winding. At least one pair of canals with one supplementary winding in each pair of canals is located along the length of the poles of the U-shaped section casing and the common pole terminal.

The advantages of the magnetic gripper, according to this invention, are the increased lifting capacity, the reduced electric power consumption, the simplified design, the reduced penetration of the magnetic field in the material, the improved gripping force for thin sheets, and a capacity for the material demagnetization and the regulation of the gripping force accompanied by reduced electric power consumption and simplified control.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
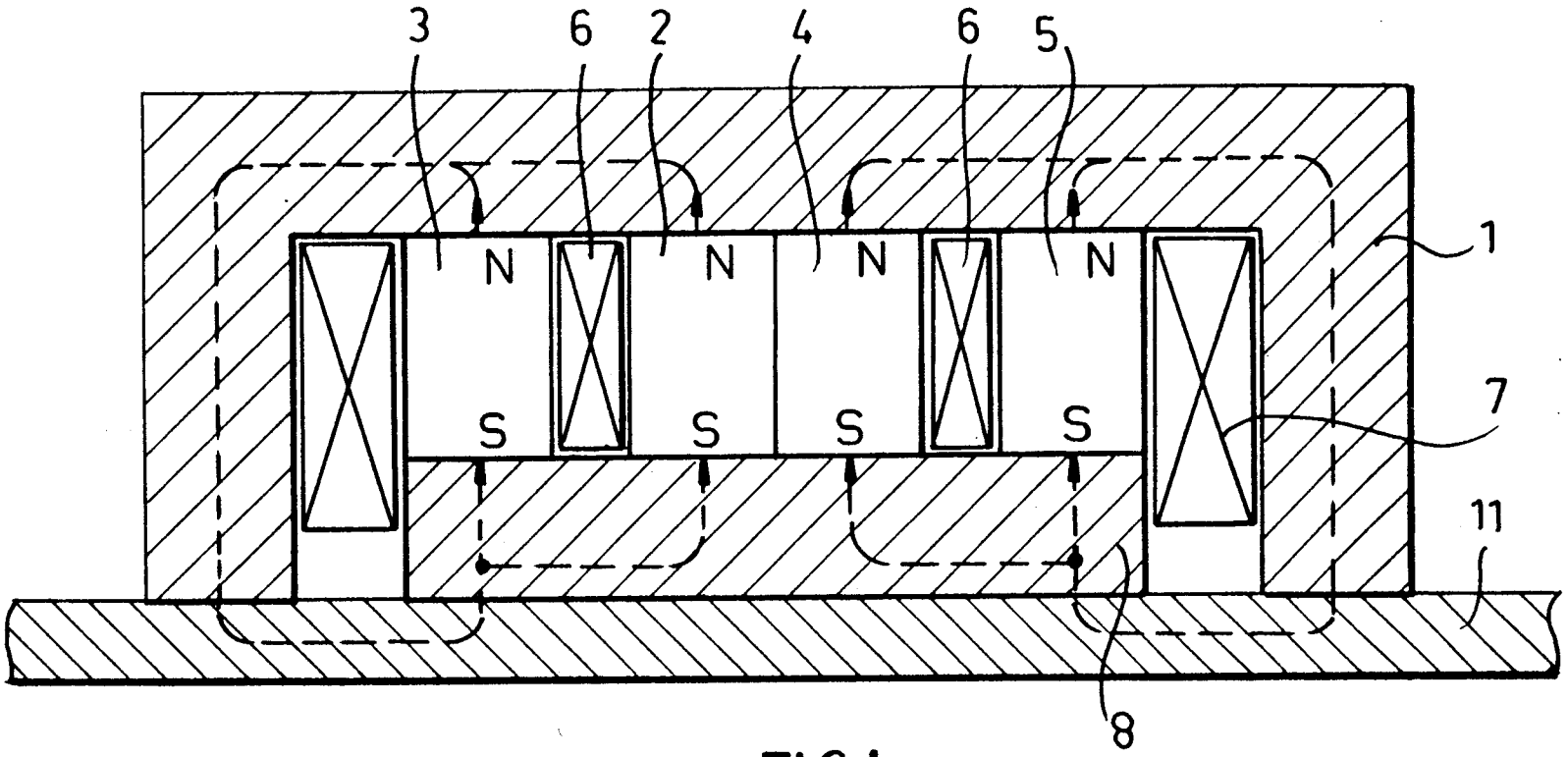
FIG. 1 is a sectional view through the device.

According to FIG. 1 the magnetic gripper consists of a casing 1 of U-shaped section, made of magnetically soft material in which are provided a pair of permanent magnets 2, 3, 4, 5. One each of permanent magnets 2, 4 of every pair is enveloped by a common neutralization winding 6, on both sides of which are fitted permanent magnets 3 and 5. All magnets 2, 3, 4 & 5 are enveloped by a magnetizing winding 7 which also envelops a common pole terminal 8.

Figure 2:
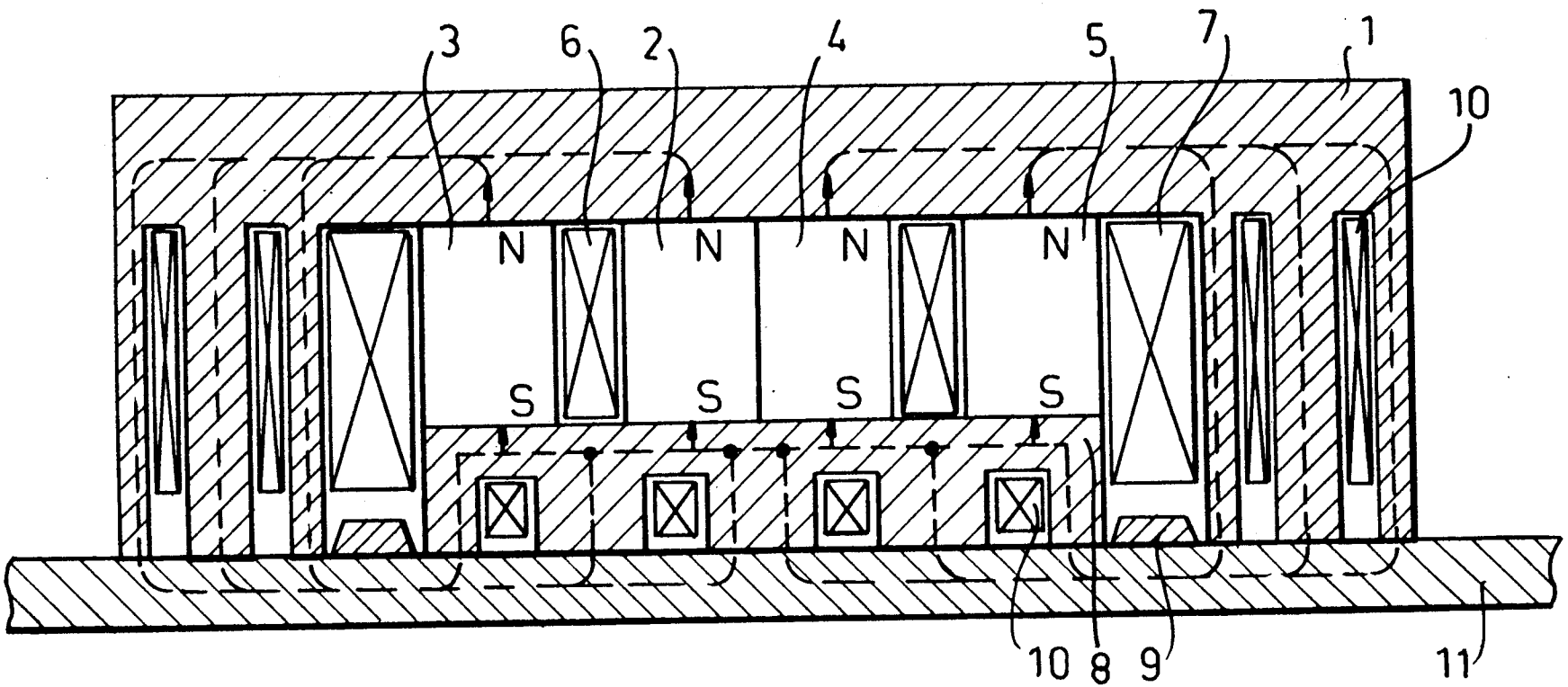
FIG. 2 is another sectional view showing supplementary windings and poles.

In another embodiment in accordance with FIG. 2, we provide supplementary poles 9 of trapeze-like section, the smaller base of the trapezoid directed to the magnetizing winding 7, in order to improve the gripping force for thin sheets, simplify the control and the abilities to regulate the gripping force and demagnetize the material, accompanied by reduced electric power consumption, between the poles of casing 1 and the common pole terminal 8, along the interpolar distances under the magnetizing winding 7. We can also provide pairs of canals in the poles of casing 1 and the common pole terminal 8 having one supplementary winding 10 in each pair of canals.

The effect of the magnetic gripping device is as follows: When thick sheets and packs of thin sheets are lifted, short-time current pulse of the magnetizing winding is fed in both the exemplary executions, where permanent magnets 2, 3, 4 & 5 are magnetized in one direction and the magnetic flux formed by them is collected in the common pole terminal 8 crossing the sheet 11 and the casing 1. The release of the sheet is effected by feeding a current pulse of the common neutralizing winding 6, whereby the neutralizing magnets 3 and 5 change their direction of magnetization and are mutually neutralized by the permanent magnets 2 & 4.

A basic problem in the thin sheets is the presence of vacuum effect between them where the sheet "becomes heavier" and their lifting one by one which is absolutely necessary in many technological operations is difficult. The supplementary windings 10, sized for short-time operation are initially energized as a result of which the upper sheet 11 is gripped. As a result of the reduced magnetic field penetration it is possible to take up separate sheets. Simultaneously, the magnetic gripper is lifted and when sheet 11 is separated from the remaining sheets, magnetizing winding 7 is energized as a result of which permanent magnets 2, 3, 4 & 5 are magnetized in one direction. The supplementary windings 10 are energized in this particular moment. The magnetic flux closes as is in the case of lifting thick sheets, the supplementary poles 9 serving to reduce the magnetic resistance between the poles of the U-shaped section casing 1 and the pole terminal 6, hence increasing the gripping force.

The regulation of the gripping force of magnetic devices using permanent magnets is a difficult and energy consuming job because of the steep curve of their demagnetization. When supplementary windings 10 are energized, the magnetic flux is summed in some sections of the pole, and is subtracted in others as a result of which a change occurs in the gripping force on a wide range with reduced energy consumption. Furthermore, there is no need for changing the operating point of the permanent magnets which simplifies the control circuit.

When the ferromagnetic material sheets have increased coercive force, the sheets remained gripped by the magnetic gripping device even after neutralization of the permanent magnets. When AC current of attenuating amplitude is fed across the supplementary windings 10 the material is demagnetized.

What is claimed is:

1. A magnetic gripper, comprising:

a casing of a magnetically soft material having an axis and formed with:

a pair of flanks spaced apart and extending generally parallel to said axis, said flanks being formed with a pair of first supplementary channels, a crosspiece bridging said flanks and traversing said axis, said crosspiece being formed with an upper inner surface, said first supplementary channels opening onto a surface of said flanks spaced from said crosspiece, and an inner magnet pole spaced axially from said upper inner surface and formed with a lower inner surface facing said inner upper surface and with a peripheral surface juxtaposed with said flanks, said inner magnet pole being formed with two second supplementary channels opening onto a bottom of said inner pole;

a first pair of permanent magnets and a second pair of permanent magnets mounted on said casing between said inner and upper surfaces and resting thereagainst, the magnets of each of said pairs being spaced from one another and forming a first coil channel therebetween, each of said pairs of magnets including a respective peripheral magnet having a flank surface facing the respective flank, said flank surface, said flanks and said peripheral surface of said inner magnet pole defining a second coil channel;

a magnetizing winding mounted on said casing in said second coil channel for exciting said magnets, said flanks and said crosspiece in one direction upon lifting a sheet of material, said magnetizing winding surrounding said peripheral surface of said inner pole;

a common neutralizing winding mounted on said casing in said first coil channel for demagnetizing the respective magnets of each of said pairs adjacent to said neutralizing winding producing a magnetic flux in a direction opposite said one direction upon releasing said sheet of material; and supplementary coils in said first and second supplementary channels for additional demagnetizing of said sheet of material upon neutralizing said permanent magnets of said pairs.

2. A magnetic gripper, comprising:

a casing of a magnetically soft material having an axis and formed with:

a pair of flanks spaced apart and extending generally parallel to said axis, a crosspiece bridging said flanks and traversing said axis, said crosspiece being formed with an upper inner surface, and an inner magnet pole spaced axially from said upper inner surface and formed with a lower inner surface facing said inner upper surface and with a peripheral surface juxtaposed with said flanks;

a first pair of permanent magnets and a second pair of permanent magnets mounted on said casing between said inner and upper surfaces and resting thereagainst, the magnets of each of said pairs being spaced from one another and forming a first coil channel therebetween, each of said pairs of magnets including a respective peripheral magnet having a side facing the respective flank, said sides of peripheral magnets, said flanks and said peripheral surface of said inner magnet pole forming a second coil channel;

a magnetizing winding mounted on said casing in said second coil channel for exciting said magnets, said flanks and said crosspiece in one direction upon lifting a sheet of material, said magnetizing winding surrounding said peripheral surface of said inner pole; and a common neutralizing winding mounted on said casing in said first coil channel for neutralizing respective magnets of each of said pairs by reversing a direction of the magnetic flux in respective magnets adjacent thereto, said sheet of material being released upon neutralizing of said permanent magnets.

3. A magnetic gripper, comprising:

a casing of a magnetically soft material having an axis and formed with:

a pair of flanks spaced apart and extending generally parallel to said axis, a crosspiece bridging said flanks and traversing said axis, said crosspiece being formed with an upper inner surface, and an inner magnet pole spaced axially from said upper inner surface and formed with a lower inner surface facing said inner upper surface and with a peripheral surface juxtaposed with said flanks;

a first pair of permanent magnets and a second pair of permanent magnets mounted on said casing between said inner and upper surfaces and resting thereagainst, the magnets of each of said pairs being spaced from one another and forming a first coil channel therebetween, said peripheral surface, said flanks and sides of the respective magnets facing said flanks forming a second coil channel;

a magnetizing winding for magnetizing said magnets, said flanks, said crosspiece and said inner pole in a direction upon lifting a sheet of material, said magnetizing winding being mounted in said second coil channel;

a common neutralizing winding mounted on said casing in said first coil channel for neutralizing respective magnets of each of said pairs adjacent to said neutralizing winding by producing a magnetic flux in an direction opposite to said one direction upon releasing said sheet of material; and at least one supplementary pole located in said second coil channel for reducing a magnetic resistance between said flanks, said inner pole of said casing and said neutralizing windings and extending toward said magnetizing winding.

4. A magnetic gripper, comprising:

a casing of a magnetically soft material having an axis and formed with:

a pair of flanks spaced apart and extending generally parallel to said axis, said flanks being formed with a pair of supplementary channels, a crosspiece bridging said flanks and traversing said axis, said crosspiece being formed with an upper inner surface, said supplementary channels opening onto a surface of said flanks opposite said upper inner surface an inner magnet pole spaced axially from said upper inner surface and formed with a lower inner surface facing said inner upper surface and with a peripheral surface juxtaposed with said flanks;

a first pair of permanent magnets and a second pair of permanent magnets mounted on said casing between said inner and upper surfaces and resting thereagainst, the magnets of each of said pairs being spaced from one another and forming a first coil channel therebetween, said peripheral surface, said flanks and sides of the respective magnets facing said flanks defining a second coil channel;

a magnetizing winding mounted on said casing in said second coil channel for magnetizing said magnets, said flanks, said crosspiece and said inner pole in one direction upon lifting a sheet of material; and a common neutralizing winding mounted on said casing in said first coil channel for neutralizing respective magnets of each of said pairs adjacent thereto producing a magnetic flux in a direction opposite said one direction, said magnetizing winding being mounted in said second coil channel, said supplementary channels in said flanks being provided with respective supplementary windings.

* * * * *